US008160281B2

(12) United States Patent
Kim et al.

(10) Patent No.: US 8,160,281 B2
(45) Date of Patent: Apr. 17, 2012

(54) SOUND REPRODUCING APPARATUS AND SOUND REPRODUCING METHOD

(75) Inventors: Young-tae Kim, Seongnam-si (KR); Kyung-yeup Kim, Yongin-si (KR); Jun-tai Kim, Yongin-si (KR); Jung-ho Kim, Yongin-si (KR); Sang-chul Ko, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 1547 days.

(21) Appl. No.: 11/220,599

(22) Filed: Sep. 8, 2005

(65) Prior Publication Data

US 2006/0050909 A1 Mar. 9, 2006

(30) Foreign Application Priority Data

Sep. 8, 2004 (KR) ..... 10-2004-0071771

(51) Int. Cl.
*H04R 5/02* (2006.01)

(52) U.S. Cl. ..... 381/310; 381/309; 381/17

(58) Field of Classification Search ..... 381/303, 381/310, 309, 17, 1, 306
See application file for complete search history.

(56) References Cited

U.S. PATENT DOCUMENTS

| | | | | |
|---|---|---|---|---|
| 6,243,476 | B1 * | 6/2001 | Gardner | 381/303 |
| 6,307,941 | B1 * | 10/2001 | Tanner et al. | 381/17 |
| 6,418,226 | B2 * | 7/2002 | Mukojima | 381/17 |
| 6,760,447 | B1 * | 7/2004 | Nelson et al. | 381/17 |
| 7,231,054 | B1 * | 6/2007 | Jot et al. | 381/310 |
| 7,382,885 | B1 * | 6/2008 | Kim et al. | 381/17 |
| 2005/0147261 | A1 * | 7/2005 | Yeh | 381/92 |
| 2007/0127738 | A1 * | 6/2007 | Yamada et al. | 381/98 |

FOREIGN PATENT DOCUMENTS

| | | | |
|---|---|---|---|
| JP | 07028482 | A | 1/1995 |
| JP | 07086859 | A | 3/1995 |
| JP | 2000-333297 | A | 11/2000 |
| JP | 200157699 | A | 2/2001 |
| JP | 2002354599 | A | 12/2002 |
| KR | 1997-0005607 | B1 | 4/1997 |

(Continued)

OTHER PUBLICATIONS

Darren B. Ward and Gary W. Elko, A New Robust System for 3d Audio Using Loudspeakers. Acoustics, Speech, and Signal Processing, 2000. ICASSP '00. Proceedings. 2000 IEEE International Conference on vol. 2, Jun. 5-9, 2000 pp:II781-II784 vol. 2 Digital Object Identifier 10.1109/ICASSP.2000.859076.*

(Continued)

*Primary Examiner* — Vivian Chin
*Assistant Examiner* — Friedrich W Fahnert
(74) *Attorney, Agent, or Firm* — Sughrue Mion, PLLC

(57) ABSTRACT

A sound reproducing apparatus and a sound reproducing method. The sound reproducing apparatus includes an actual listening environment feature function database where an actual listening space feature function is stored for correcting the virtual source in response to a feature of an actual listening space provided at the time of listening; and an actual listening space feature correcting unit of reading out the actual listening space feature function stored in the actual listening environment feature function database, and correcting the virtual source based on the reading result. Accordingly, causes of each distortion may be removed to provide sounds having the best quality.

26 Claims, 6 Drawing Sheets

FOREIGN PATENT DOCUMENTS

| | | | |
|---|---|---|---|
| KR | 19970005607 | * | 4/1997 |
| KR | 1999-0040058 | A | 6/1999 |
| KR | 2001-0001993 | A | 1/2001 |
| KR | 2001-0042151 | A | 5/2001 |

OTHER PUBLICATIONS

Two speakers are better than 5.1 [surround sound], Kraemer, A.; Spectrum, IEEE, vol. 38, Issue 5, May 2001 pp:70-74; Digital Object Identifier 10.1109/6.920034.*

Brian Dipert, Decoding and virtualization brings surround sound to the masses, EDN, Oct. 25, 2001, pp. 63, 64, 66, 68, 70, 72, 74.*

Heesoo Lee, Device for Correcting Characteristics of Hearing Space, PN 19970005607, date: Apr. 18, 1997, CC: KR Translated by: Schreiber Translation, Inc., Washington, D.C., Aug. 2009. PTO 09-7410.*

Heesoo Lee, Device for Correcting Characteristics of Heasing Space, 1997, Translated by Schreiber Translation, Inc.*

* cited by examiner

SOUND REPRODUCING APPARATUS AND SOUND REPRODUCING METHOD

CROSS-REFERENCE TO RELATED APPLICATIONS

This application claims priority under 35 U.S.C. §119 from Korean Patent Application No. 2004-71771, filed on Sep. 8, 2004, in the Korean Intellectual Property Office, the entire content of which is incorporated herein by reference.

BACKGROUND OF THE INVENTION

1. Field of the Invention

The present invention relates to a sound reproducing apparatus and a sound reproducing method and, more particularly, to a sound reproducing apparatus employing a head related transfer function (HRTF) to generate a virtual source and a sound reproducing method using the same.

2. Description of the Related Art

In the audio industry of the related art, output sounds were formed on a one-dimensional front or two-dimensional plane to generate substantial sounds close to vivid realism. In recent years, most sound reproducing apparatus have thus reproduced stereo sound signals from mono sound signals. However, the presence range which may be detected by sound signals generated when the stereo sound signals are reproduced was limited depending on a position of a speaker. To cope with this limit, research was conducted on an improvement of speaker reproduction capability and reproduction of virtual signals by means of signal processing in order to extend the present range.

As a result of such research, there exists a representative surround stereophonic system which uses five speakers. It separately processes virtual signals output from a rear speaker. A method of forming such virtual signals includes having a delay in response to a spatial movement of the signal and reducing the signal size to deliver it to the rear direction. To deal with this, most of the current sound reproducing apparatuses employ a stereophonic technique referred to as DOLBY PROLOGIC SURROUND, so that vivid sounds having the same level as the movie may be experienced even at home.

As such, vivid sounds close to presence may be obtained when the number of channels increases, however, it requires the number of speakers to be additionally increased by the increased number of channels, which causes cost and installation space to be increased.

Such problems may be improved by applying research results about how humans hear and recognize sounds in a three-dimensional space. In particular, much research has been conducted on how humans can recognize the three-dimensional sound space in recent years, which generates virtual sources to be employed in an application field thereof.

When such a virtual source concept is employed in the sound reproducing apparatus, that is, when sound sources in several directions may be provided using a predetermined number of speakers, for example, two speakers instead of using several speakers in order to reproduce the stereo sound, the sound reproducing apparatus is provided with significant advantages. First, there is an economical advantage by using a reduced number of speakers, and second, there is an advantage of a reduced space occupied by the system.

As such, when the conventional sound reproducing apparatus is employed to localize the virtual source, a HRTF measured in an anechoic chamber or a modified HRTF was used. However, when such a conventional sound reproducing apparatus is employed, a stereophonic effect which has been reflected at the time of recording is removed, so that listeners hear the sound which is not an initially optimized sound but a distorted one. As a result, sounds required by the listeners were not properly provided. To solve this problem, a room transfer function (RTF) measured in an optimal listening space is used instead of the HRTF measured in an anechoic chamber. However, the RTF used for correcting the sound requires a large number of data to be processed as compared to the HRTF. As a result, a separate high performance processor capable of operating main factors within a circuit in real time, and a memory having a relatively high capacity are required.

In addition, existing reproduced sounds, which were intended to have features of the optimal listening space and the sound reproducing apparatus at the time of recording, become actually distorted depending on the listening space and speakers used by listeners.

SUMMARY OF THE INVENTION

It is therefore one object of the present invention to provide a sound reproducing apparatus and a sound reproducing method capable of correcting distortions due to an actual listening space by correcting the feature of the actual listening space to have a virtual source generated from the HRTF.

It is another object of the present invention to provide a sound reproducing apparatus and a sound reproducing method capable of correcting distortions due to speakers by correcting the speaker feature to a virtual source generated from the HRTF.

It is another object of the present invention to provide a sound reproducing apparatus and a sound reproducing method capable of having listeners feel that they listen to sounds of virtual sources generated from the HRTF in an optimal listening space.

According to one aspect of the present invention, there is provided a sound reproducing apparatus in which audio data input through input channels is generated as a virtual source by a Head Related Transfer Function (HRTF) and a sound signal resulted from the generated virtual source is output through a speaker, which may include: an actual listening environment feature function database where an actual listening space feature function is stored for correcting the virtual source in response to a feature of an actual listening space provided at the time of listening; and an actual listening space feature correcting unit of reading out the actual listening space feature function stored in the actual listening environment feature function database, and correcting the virtual source based on the reading result.

The sound reproducing apparatus may further include a speaker feature correcting unit of reading out a speaker feature function stored in the actual listening environment feature function database and correcting the virtual source based on the reading result, wherein the speaker feature function for correcting the virtual source in response to the speaker feature provided at the time of listening is further stored in the actual listening environment feature function database.

The sound reproducing apparatus may further include a virtual listening space parameter storing unit of storing a virtual listening space parameter set to allow the sound signal resulted from the virtual source to be output to an expected optimal listening space; and a virtual listening space correcting unit of reading out the virtual listening space parameter stored in the virtual listening space parameter storing unit, and correcting the virtual source based on the reading result.

The virtual listening space correcting unit may perform correction only on a virtual source corresponding to audio data input from a front channel among the input channels.

The virtual listening space correcting unit may perform correction only on a virtual source corresponding to audio data input from a rear channel among the input channels.

According to another aspect of the present invention, there is provided a sound reproducing apparatus in which audio data input through input channels are generated as virtual sources by a Head Related Transfer Function (HRTF) and a sound signal resulted from the generated virtual sources is output through a speaker, which may include: an actual listening environment feature function database where a speaker feature function is stored for correcting the virtual source in response to a feature of a speaker provided at the time of listening; and a speaker feature correcting unit of reading out the speaker feature function stored in the actual listening environment feature function database, and correcting the virtual source based on the reading result.

According to another aspect of the present invention, there is provided a sound reproducing apparatus in which audio data input through input channels are generated as virtual sources by a Head Related Transfer Function (HRTF) and a sound signal resulted from the generated virtual sources is output through a speaker, which may include: a virtual listening space parameter storing unit of storing a virtual listening space parameter set to allow the sound signal resulted from the virtual source to be output to an expected optimal listening space; and a virtual listening space correcting unit of reading out the virtual listening space parameter stored in the virtual listening space parameter storing unit, and correcting the virtual source based on the reading result.

According to still another aspect of the present invention, there is provided a sound reproducing apparatus in which audio data input through input channels are generated as virtual sources by a Head Related Transfer Function (HRTF) and a sound signal resulted from the generated virtual sources is output through a speaker, which may include: (a) correcting the virtual source based on an actual listening space feature function for correcting the virtual source in response to a feature of an actual listening space provided at the time of listening.

BRIEF DESCRIPTION OF THE DRAWINGS

The above aspects and features of the present invention will be more apparent by describing exemplary embodiments of the present invention with reference to the accompanying drawings, in which.

Figure 1:
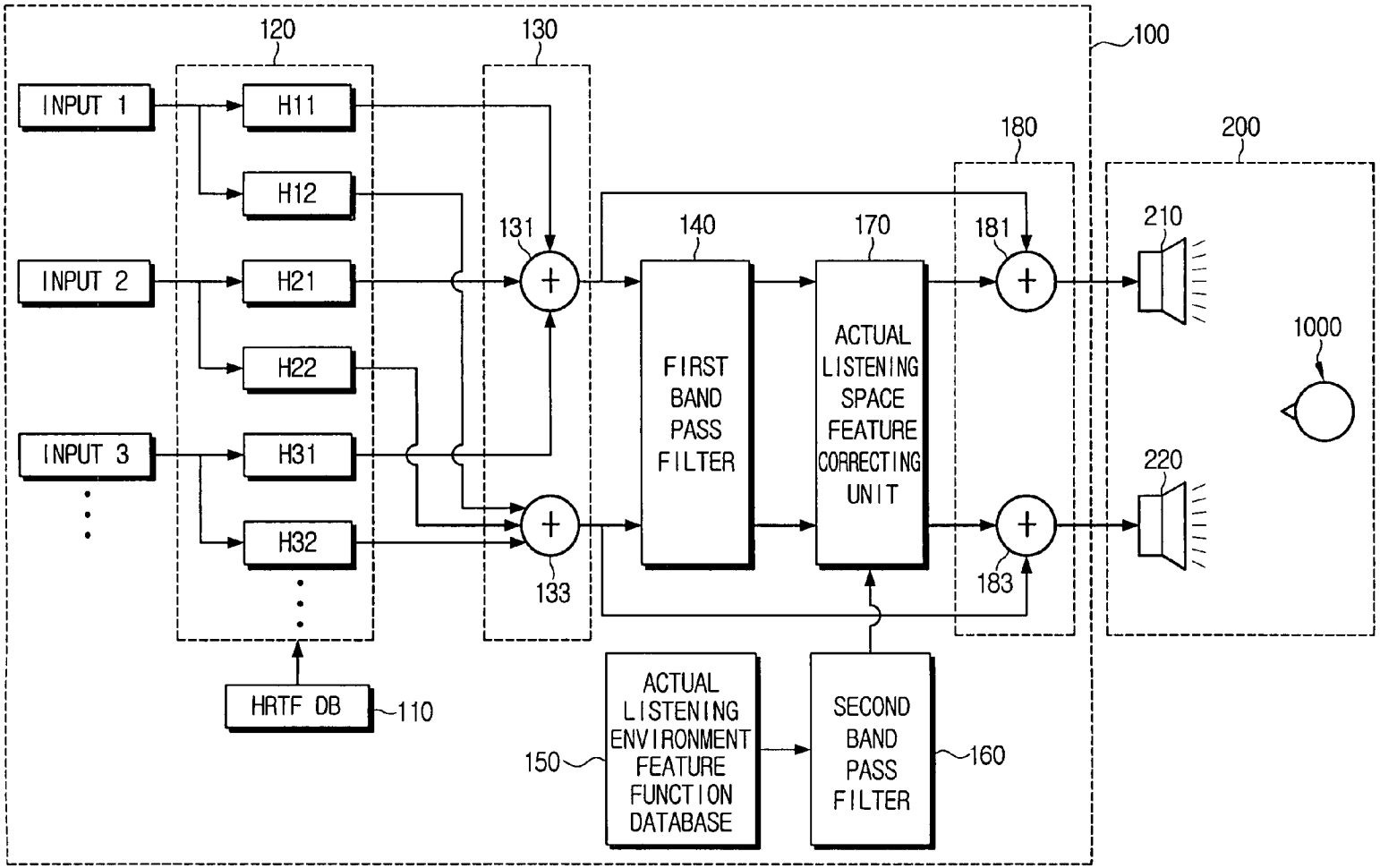
FIG. 1 is a block view illustrating a sound reproducing apparatus in accordance with one exemplary embodiment of the present invention, which is directed to the sound reproducing apparatus of correcting a feature of an actual listening space.

DETAILED DESCRIPTION OF THE ILLUSTRATIVE NON-LIMITING EMBODIMENTS OF THE INVENTION

Hereinafter, the present invention will be described in detail by way of exemplary embodiments with reference to the drawings. The described exemplary embodiments are intended to assist in the inderstanding of the invention, and are not intended to limit the scope of the invention in any way. Throughout the drawings for explaining the exemplary embodiments, those components having identical functions carry the same reference numerals for which duplicate explanations will be omitted.

FIG. 1 is a block view illustrating a sound reproducing apparatus in accordance with one exemplary embodiment of the present invention, which is directed to the sound reproducing apparatus of correcting a feature of an actual listening space.

A sound reproducing apparatus 100 according to the present exemplary embodiment includes a HRTF database 110, a HRTF applying unit 120, a first synthesizing unit 130, a first band pass filter 140, an actual listening environment feature function database 150, a second band pass filter 160, an actual listening space feature correcting unit 170, and a second synthesizing unit 180.

The HRTF database 110 stores a HRTF measured in an anechoic chamber. The HRTF according to an exemplary the present invention means one in a frequency domain which represents sound waves propagating from a sound source of the anechoic chamber to external ears of human ears. That is, in terms of the structural ears, a frequency spectrum of signals reaching the ears first reaches the external ears and is distorted due to an irregular shape of an earflap, and such a distortion is varied relying on sound direction and distance and so forth, so that this change of frequency component plays a significant role on the sound direction recognized by humans. Such a degree of representing the frequency distortion refers to the HRTF. This HRTF may be employed to reproduce a three-dimensional stereo sound field.

The HRTF applying unit 120 applies HRTFs H11, H12, H21, H22, H31, and H32 stored in the HRTF database 110 to audio data which are provided from an external means of providing sound signals (not shown) and are input through an input channel. As a result, left virtual sources and right virtual sources are generated.

Only three input channels are illustrated in the exemplary embodiment described hereinafter for simplicity of drawings, and six resultant HRTFs are accordingly shown. However, the claims of the present invention are not limited to the number of input channels and the number of HRTFs.

The HRTFs H11, H12, H21, H22, H31, and H32 within the HRTF applying unit 120 consist of left HRTFs H11, H21, and H31 applied when sound sources to be output to a left speaker 210 are generated, and right HRTFs H12, H22, and H32 applied when sound sources to be output to a right speaker 220 are generated.

The first synthesizing unit 130 consists of a first left synthesizing unit 131 and a first right synthesizing unit 133. The first left synthesizing unit 131 synthesizes left virtual sources output from the left HRTFs H11, H21, and H31 to generate left synthesized virtual sources, and the first right synthesizing unit 133 synthesizes right virtual sources output from the right HRTFs H12, H22, H32, H42, and H52 to generate right synthesized virtual sources.

The first band pass filter 140 receives left synthesized virtual sources and right synthesized virtual sources output from the first left synthesizing unit 131 and the first right synthesizing unit 133, respectively. Only a region to be corrected among left input synthesized virtual sources is passed by the first band pass filter 140. Only a region to be corrected among right input synthesized virtual sources is passed by the first band pass filter 140. Accordingly, only the passed regions to be corrected among the right and left synthesized virtual sources are output to the actual listening space feature correcting unit 170. However, a filtering procedure using the first band pass filter 140 is not a requirement but a selective option.

The actual listening environment feature function database 150 stores actual listening environment feature functions. In this case, the actual listening environment feature function mean ones that impulse signals generated in speakers by the operation of a listener 1000 are measured and computed at a listening position of the listener 1000. As a result, features of the speakers 210 and 220 are considered for the actual listening environment feature function. That is, the listening environment features mean ones which consider all of the listening space features and the speaker features. The features of the actual listening space 200 are defined by size, width, length, and so forth of a place where the sound reproducing apparatus 100 is put (e.g. room, living room). Such an actual listening environment feature function may be still used with initial one-time measurement as long as the position and the place of the sound reproducing apparatus 100 are not changed. In addition, the actual listening environment feature function may be measured using an external input device such as a remote control.

The second band pass filter 160 extracts a portion of an early reflected sound from the actual listening environment feature function of the actual listening environment feature function database 150. In this case, the actual listening environment feature function is classified into a portion having a direct sound and a portion having a reflected sound, and the portion having the reflected sound is classified again into a direct reflected sound, an early reflected sound, and a late reflected sound. The early reflected sound is extracted from the second band pass filter 160 in accordance an exemplary embodiment of with the present invention. This is because that the early reflected sound plays the most significant effect on the actual listening space 200 so that only the early reflected sound is extracted.

The actual listening space feature correcting unit 170 corrects the correction regions of right and left synthesized virtual sources output from the first band pass filter 140 with respect to the actual listening space 200, wherein it performs the correction based on the portion having the early reflected sound of the actual listening environment feature function which has passed the second band pass filter 160. This is for the sake of excluding the feature of the actual listening space 200 so as to allow the listener 1000 to always listen to sounds output from the actual listening space feature correcting unit 170 in an optimal listening space.

The second synthesizing unit 180 includes a second left synthesizing unit 181 and a second right synthesizing unit 183.

The second left synthesizing unit 181 synthesizes the correction region of the left synthesized virtual source corrected from the actual listening space feature correcting unit 170, and the rest region of the left synthesized virtual source which has not passed the first band pass filter 140. The sound signal resulted from the left synthesized final virtual source is provided to the listener 1000 through the left speaker 210.

The second right synthesizing unit 183 synthesizes the correction region of the right synthesized virtual source corrected from the actual listening space feature correcting unit 170, and the rest region of the right synthesized virtual source which has not passed the first band pass filter 140. The sound signal resulted from the right synthesized final virtual source is provided to the listener 1000 through the right speaker 220.

As a result, the final virtual source has the feature which is corrected with respect to the actual listening space 200 in accordance with the present exemplary embodiment, and the listener 1000 listens to the sound which is reflected with the feature of the actual listening space.

Figure 2:
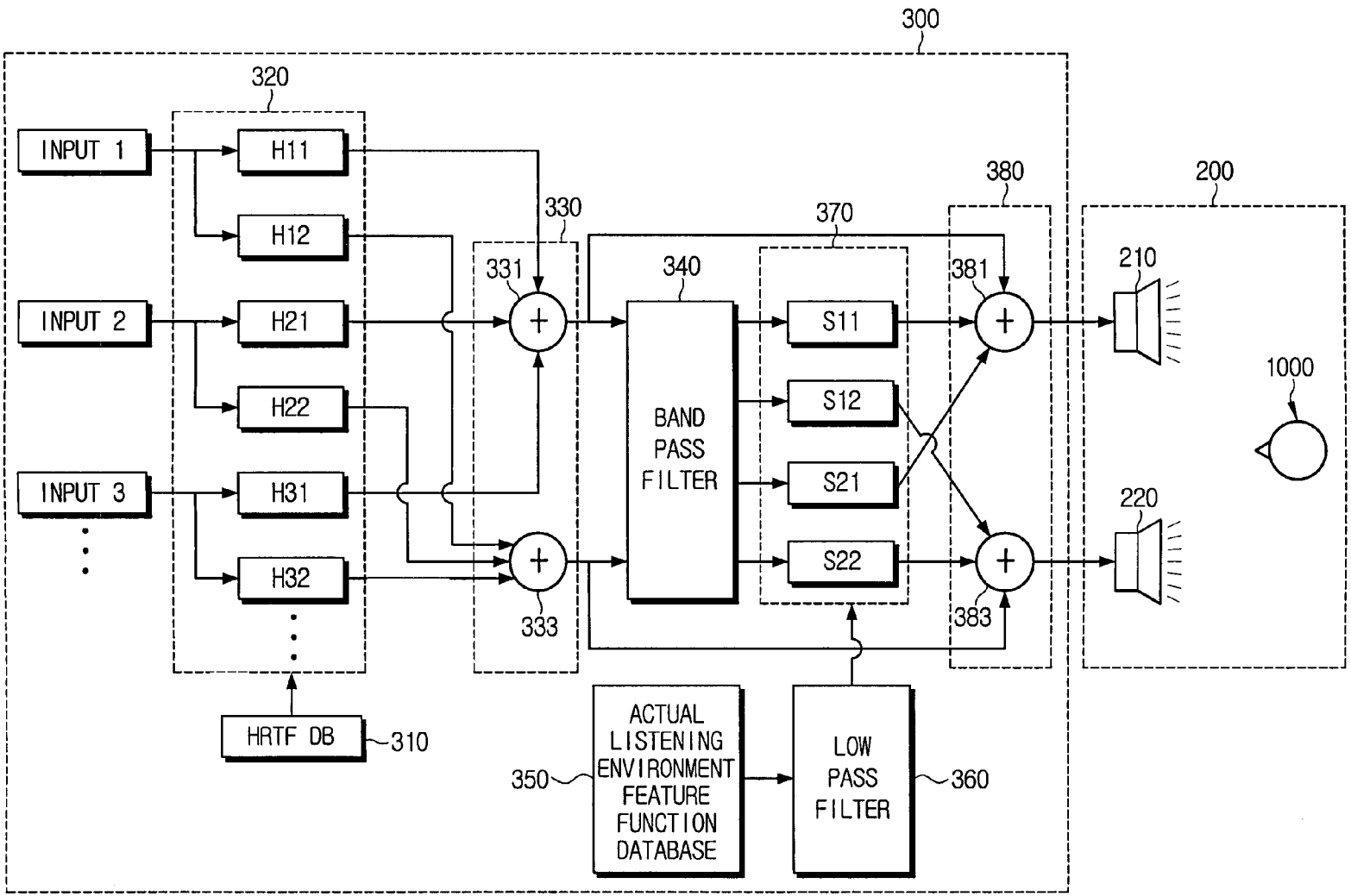
FIG. 2 is a block view illustrating a sound reproducing apparatus in accordance with other exemplary embodiment of the present invention, which is directed to the sound reproducing apparatus of correcting features of speakers 210 and 220.

FIG. 2 is a block view illustrating a sound reproducing apparatus in accordance with another exemplary embodiment of the present invention, which is directed to the sound reproducing apparatus of correcting features of speakers 210 and 220.

A sound reproducing apparatus 300 according to an exemplary embodiment of the present invention includes a HRTF database 310, a HRTF applying unit 320, a first synthesizing unit 330, a band pass filter 340, an actual listening environment feature function database 350, a low pass filter 360, a speaker feature correcting unit 370, and a second synthesizing unit 380.

A description of the HRTF database 310, the HRTF applying unit 320, the first synthesizing unit 330, and the actual listening environment feature function database 350 according to the exemplary embodiment of FIG. 2 is equal to that of the HRTF database 110, the HRTF applying unit 120, the first synthesizing unit 130, and the actual listening environment feature function database 150 according to the exemplary embodiment of FIG. 1, so that the common description thereof will be skipped, and characteristic descriptions will be hereinafter given to the present exemplary embodiment.

The low pass filter 360 according to the present exemplary embodiment extracts only a portion with respect to a direct sound from the actual listening environment feature function of the actual listening environment feature function database 350. This is because the direct sound has the most significant effect on the speaker so that only the direct sound is extracted.

The band pass filter 340 receives left synthesized virtual sources and right synthesized virtual sources output from the first left synthesizing unit 331 and the first right synthesizing unit 333, respectively. Only a region to be corrected among left input synthesized virtual sources is passed by the low pass filter 360. Only a region to be corrected among right input synthesized virtual sources is passed by the low pass filter 360. Additionally, only the regions to be corrected among the left input synthesized virtual sources are passed by the band pass filter 340 and only the regions to be corrected among the right input synthesized virtual sources are passed by the band pass filter 340. Accordingly, the passed regions to be corrected among the right and left synthesized virtual sources are output to the actual listening space feature correcting unit 370. However, a filtering procedure using the band pass filter 340 is not a requirement but a selective option.

The speaker feature correcting unit 370 corrects the correction regions of right and left synthesized virtual sources output from the band pass filter 340 with respect to the actual listening space 200, wherein it performs the correction based on the portion having the direct sound of the actual listening environment feature function which has passed the band pass filter 340. As a result, the correction allows a flat response feature to be obtained from the speaker feature correcting unit 370. This is for the sake of correcting the sound reproduced through the right and left speakers 220 and 210 which are distorted in response to the feature of the actual listening environment to which the listener belongs. In order to perform this correction, the speaker feature correcting unit 370 has four correcting filters S11, S12, S21, and S22. The first correcting filter S11 and the second correcting filter S12 among the four correcting filters correct the regions to be corrected among the left synthesized virtual sources output from the first left synthesizing unit 331, and the other two correcting filters, that is, the third correcting filter S21 and the fourth correcting filter S22 among the four correcting filters correct the portions to be corrected among the right synthesized virtual sources output from the first right synthesizing unit 133. In addition, the number of the correcting filters S11, S12, S21, and S22 is determined by four propagation paths resulted from two ears of humans and two of right and left speakers 220 and 210. Accordingly, the correcting filters S11, S12, S21, and S22 are provided to correspond to respective propagation paths.

By way of example, regions to be corrected among the left synthesized virtual sources output from the band pass filter 340 are input to two correction filters S11 and S12 and corrected therein, and regions to be corrected among the right synthesized virtual sources output from the band pass filter 340 are input to two correction filters S21 and S22 and corrected therein.

The second synthesizing unit 380 includes a second left synthesizing unit 381 and a second right synthesizing unit 383.

The second left synthesizing unit 381 receives the virtual sources corrected by the first and third correcting filters S11 and S21. In addition, the rest of the regions, except the regions to be corrected among the left synthesized virtual sources, are input to the second left synthesizing unit 381. The second left synthesizing unit 381 synthesizes respective sounds to generate final left virtual sources, and externally outputs the sound signals resulted therefrom through the left speaker 210.

The second right synthesizing unit 383 receives the virtual sources corrected by the second and fourth correcting filters S12 and S22. In addition, the rest of the regions, except the regions to be corrected among the right synthesized virtual sources, are input to the second right synthesizing unit 383. The second right synthesizing unit 383 synthesizes respective sounds to generate final right virtual sources, and externally outputs the sound signals resulted therefrom through the right speaker 220.

As a result, the final virtual sources have the corrected features with respect to the speaker that the listener 1000 has in accordance with the present exemplary embodiment, and the listener 1000 may listen to sounds in which the features of the speaker owned by the listener 1000 are excluded.

Figure 3:
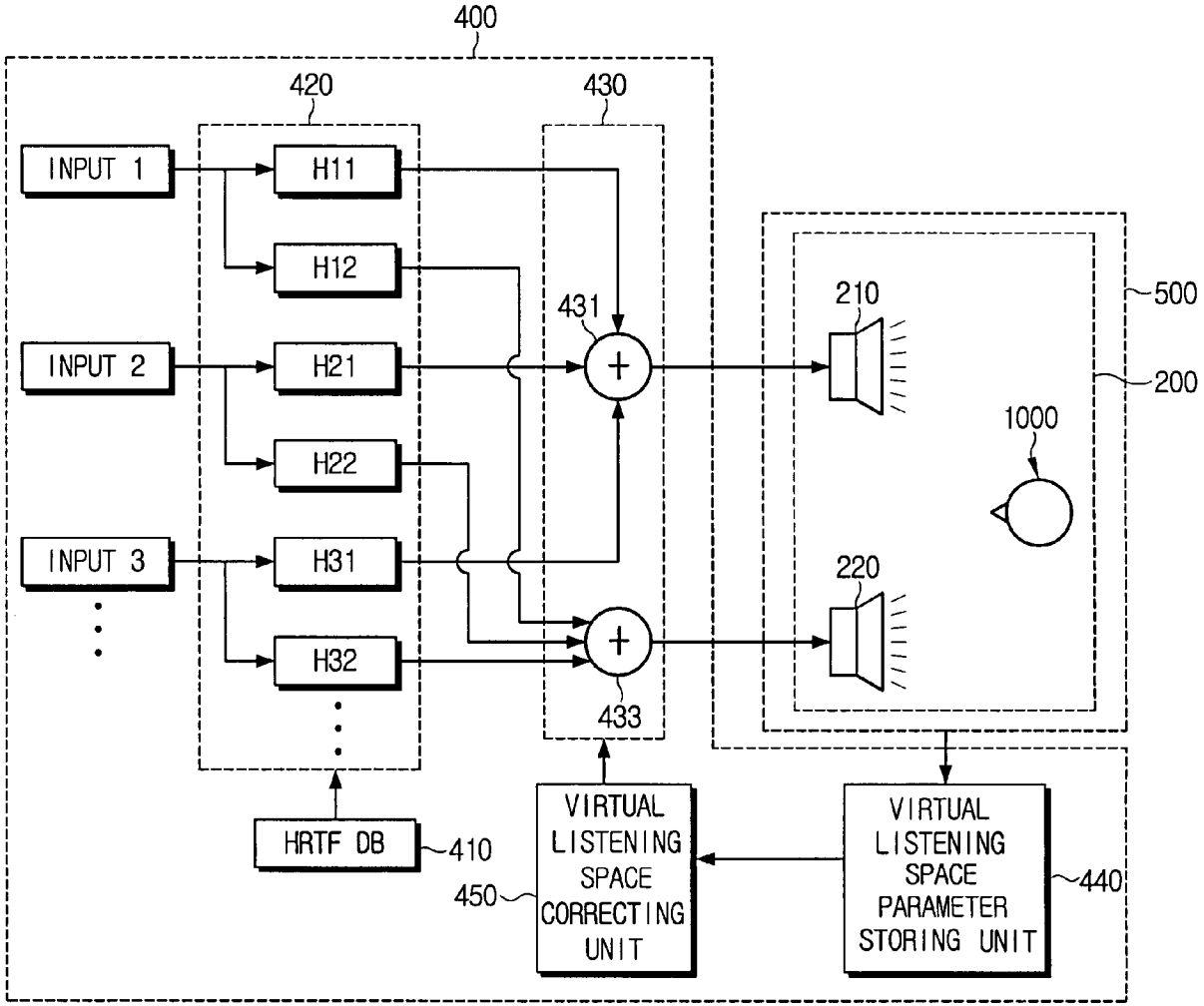
FIG. 3 is a block view illustrating a sound reproducing apparatus in accordance with another exemplary embodiment of the present invention, which is directed to the sound reproducing apparatus which corrects all channels in order to have listeners recognize that they listen to sounds in an optimal listening space.

FIG. 3 is a block view illustrating a sound reproducing apparatus in accordance with another exemplary embodiment of the present invention, which is directed to the sound reproducing apparatus which corrects all channels in order to have listeners recognize that they listen to sounds in an optimal listening space.

A sound reproducing apparatus 400 according to the present exemplary embodiment includes a HRTF database 410, a HRTF applying unit 420, a synthesizing unit 430, a virtual listening space parameter storing unit 440, and a virtual listening space correcting unit 450.

A description of the HRTF database 410 and the HRTF applying unit 420 according to the exemplary embodiment of FIG. 3 is equal to that of the HRTF database 110 and the HRTF applying unit 120 according to the exemplary embodiment of FIG. 1, so that the common description thereof will be skipped, and characteristic descriptions will be hereinafter given to the present exemplary embodiment.

The virtual listening space parameter storing unit 440 stores parameters for an optimal listening space. In this case, the expected parameter of the optimal listening space means one with respect to atmospheric absorption degree, reflectivity, size of the virtual listening space 500, and so forth, and is set by a non-real time analysis.

The virtual listening space correcting unit 450 corrects the virtual sources by using each parameter set by the virtual listening space parameter storing unit 440. That is, in any environment to that the listener 1000 belongs, it performs the correction so as to allow the listener to recognize that he or she always listens in the virtual listening environment. This is required because of a current technical limit which defines the sound image using a HRTF measured in an anechoic chamber. The virtual listening space 500 means an idealistic listening space, for example, a recording space to which initially recorded sounds were applied.

To this end, the virtual listening space correcting unit 450 provides each parameter to the left synthesizing unit 431 and the right synthesizing unit 433 of the synthesizing unit 430, and the right and left synthesizing units 433 and 431 synthesize right and left synthesized virtual sources, respectively to generate final right and left virtual sources. Sound signals resulted from the generated right and left virtual sources are externally output through the right and left speakers 220 and 210.

Accordingly, the final virtual sources allow the listener 1000 to feel that he or she listens in an optimal virtual listening space 500 in accordance with the present exemplary embodiment.

Figure 4:
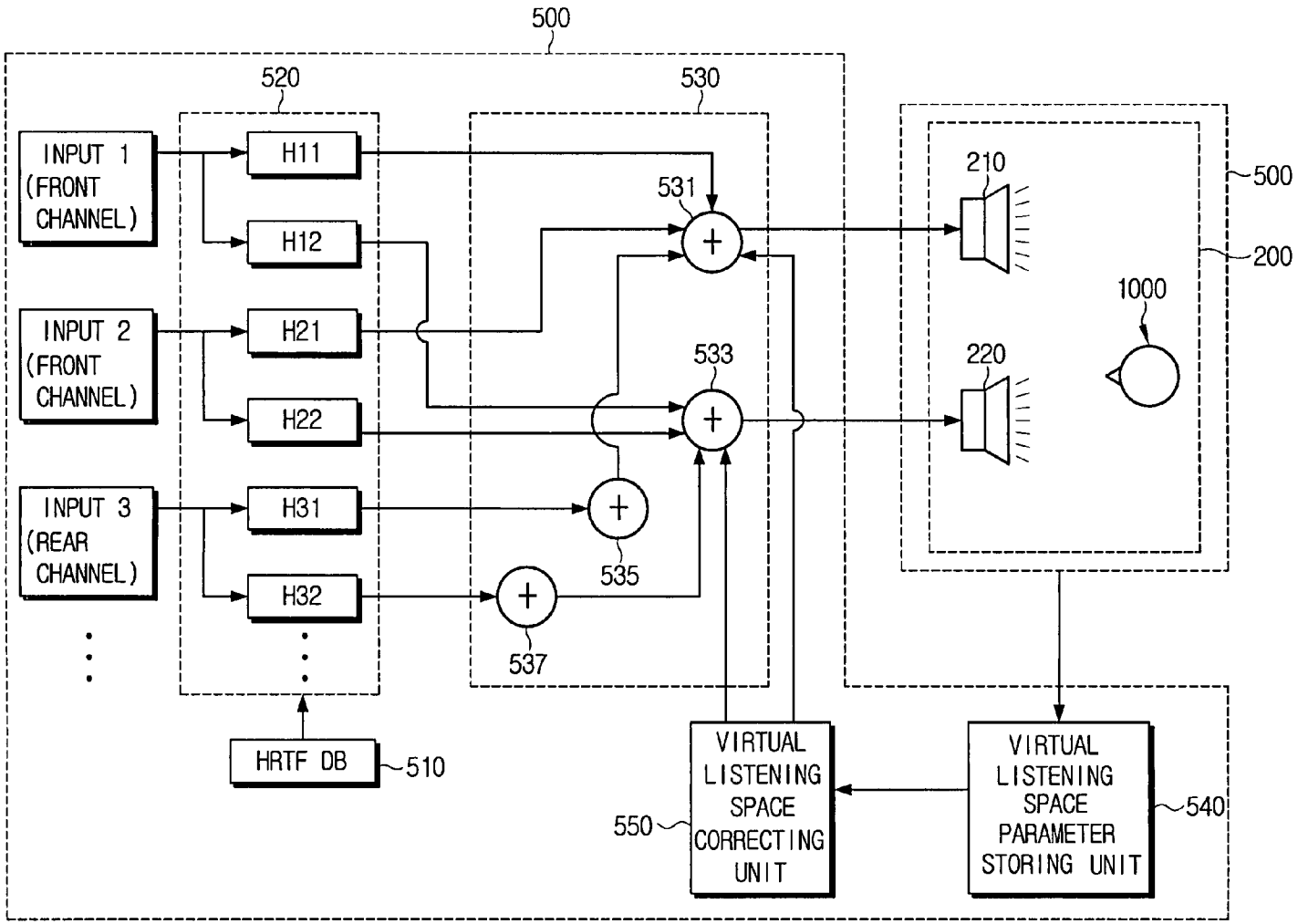
FIG. 4 is a block view illustrating a sound reproducing apparatus in accordance with still another exemplary embodiment of the present invention, which is directed to the sound reproducing apparatus which corrects only front channels in order to have listeners recognize that they listen to sounds in an optimal listening space.

FIG. 4 is a block view illustrating a sound reproducing apparatus in accordance with still another exemplary embodiment of the present invention, which is directed to the sound reproducing apparatus which corrects only front channels in order to have listeners recognize that they listen to sounds in an optimal listening space.

A description of a HRTF database 510 and a HRTF applying unit 520 according to the exemplary embodiment of FIG. 4 is equal to that of the HRTF database 110 and the HRTF applying unit 120 according to the exemplary embodiment of FIG. 1, so that the common description thereof will be skipped, and a description of a virtual listening space parameter storing unit 540 according to the exemplary embodiment of FIG. 4 is also equal to that of the virtual listening space parameter storing unit 440 according to the exemplary embodiment of FIG. 3, so that the common description thereof will be skipped, and characteristic descriptions will be hereinafter given to the present exemplary embodiment.

The exemplary embodiment of FIG. 4 differs from that of FIG. 3 in that a method of applying each parameter is performed only on front channels when the correction for having the listener recognize that he or she listens in the optimal listening space is performed.

The reason why each parameter is applied only to the front channels is as follows. When the HRTF is typically used to localize the virtual source in front of the listener 1000, the listener 1000 may correctly recognize the directivity of the sound source, however, the extending effect of sound field (i.e. surround effect) is removed when it is localized by the HRTF. Accordingly, in order to cope with this problem, each parameter is applied only to the front channels so that the listener 1000 may recognize the extending effect of sound field from the front localized virtual sources by the HRTF.

The virtual listening space correcting unit 550 according to the present exemplary embodiment reads out virtual listening space parameters stored in the virtual listening space parameter storing unit 540, and applies them to the synthesizing unit 530.

The synthesizing unit 530 according to the present exemplary embodiment has a final left synthesizing unit 531 and a final right synthesizing unit 533. In addition, it has an intermediate left synthesizing unit 535 and an intermediate right synthesizing unit 537.

Audio data input to the left HRTFs H11 and H21 among audio data input to the front channels INPUT1 and INPUT2 pass through the left HRTFs H11 and H21 to be output to the final left synthesizing unit 531. In addition, audio data input to the right HRTFs H12 and H22 Among audio data input to the front channels INPUT1 and INPUT2 pass through the right HRTFs H12 and H22 to be output to the final right synthesizing unit 533.

In the meantime, audio data input to the left HRTF H31 among audio data input to the rear channel INPUT3 pass through the left HRTF H31 to be output to the intermediate left synthesizing unit 535 as left virtual sources. In addition, audio data input to the right HRTF H32 among audio data input to the rear channel INPUT3 pass through the right HRTF H32 to be output to the intermediate right synthesizing unit 537 as right virtual sources. Only one rear channel INPUT3 is shown in the drawing for simplicity of drawings, however, the number of the rear channel may be two or more.

The intermediate right and left synthesizing units 535 and 537 synthesize right and left virtual sources input from the rear channel INPUT3, respectively. And the left virtual sources synthesized in the intermediate left synthesizing unit 535 are output to the final left synthesizing unit 531, and the right virtual sources synthesized in the intermediate right synthesizing unit 537 are output to the final right synthesizing unit 533, respectively.

The final right and left synthesizing units 533 and 531 synthesize virtual sources output from the intermediate right and left synthesizing units 535 and 537, virtual sources output directly from the HRTFs H11, H12, H21, and H22, and virtual listening space parameters. That is, the virtual sources output from the intermediate left synthesizing unit 535 are synthesized in the final left synthesizing unit 531, and virtual sources output from the intermediate right synthesizing unit 537 are synthesized in the final right synthesizing unit 537, respectively.

Sound signals resulted from the final right and left virtual sources which are synthesized in the final right and left synthesizing units 533 and 531 are externally output through the right and left speakers 220 and 210, respectively.

Figure 5:
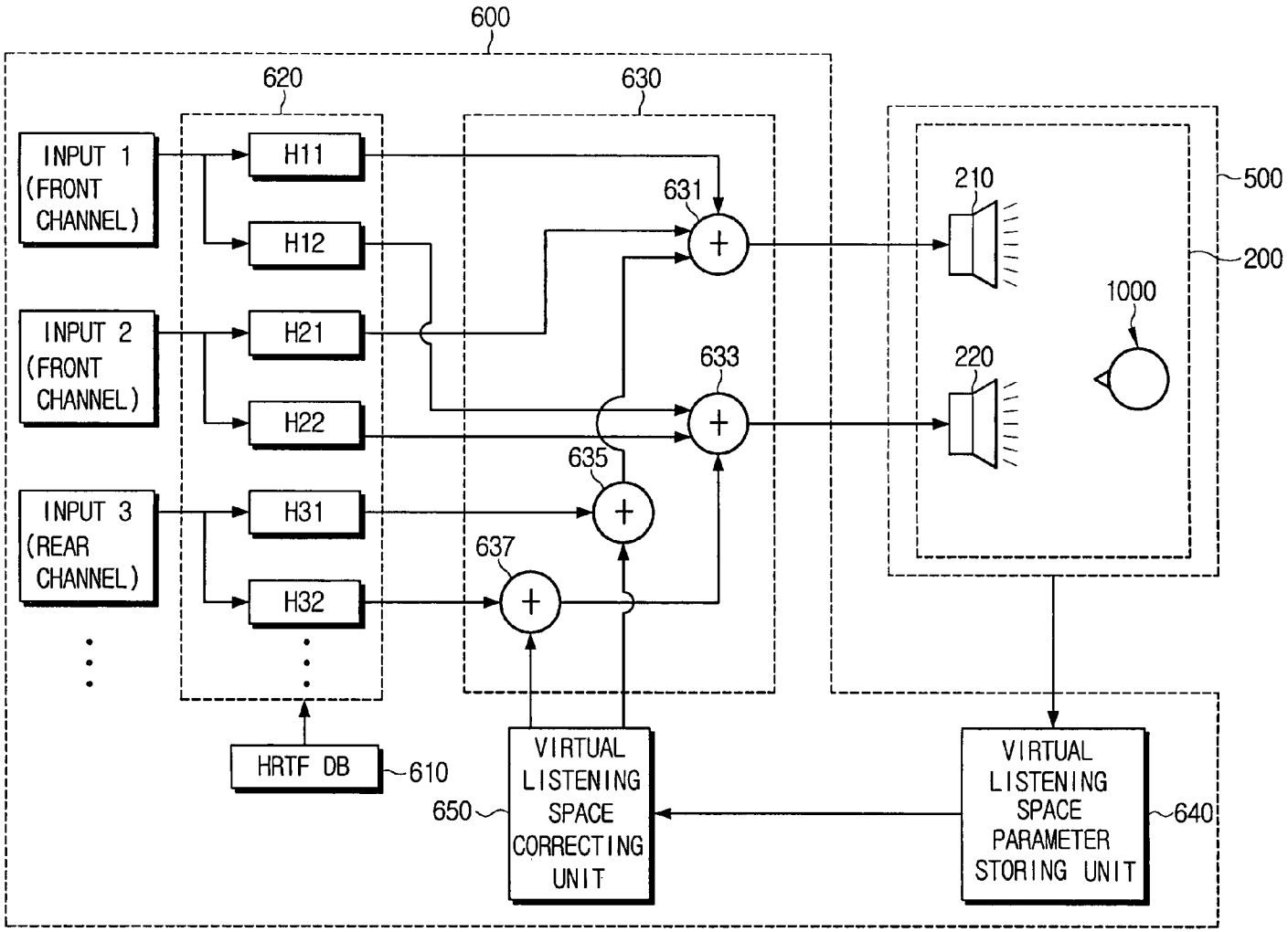
FIG. 5 is a block view illustrating a sound reproducing apparatus in accordance with yet another exemplary embodiment of the present invention, which is directed to the sound reproducing apparatus which corrects only rear channels in order to have listeners recognize that they listen to sounds in an optimal listening space.

FIG. 5 is a block view illustrating a sound reproducing apparatus in accordance with yet another exemplary embodiment of the present invention, which is directed to the sound reproducing apparatus which corrects only rear channels in order to have listeners recognize that they listen to sounds in an optimal listening space.

A description of a HRTF database 610 and a HRTF applying unit 620 according to the exemplary embodiment of FIG. 5 is equal to that of the HRTF database 110 and the HRTF applying unit 120 according to the exemplary embodiment of FIG. 1, so that the common description thereof will be skipped, and a description of a virtual listening space parameter storing unit 640 according to the exemplary embodiment of FIG. 5 is also equal to that of the virtual listening space parameter storing unit 440 according to the exemplary embodiment of FIG. 3, so that the common description thereof will be skipped, and characteristic descriptions will be hereinafter given to the present exemplary embodiment.

The exemplary embodiment of FIG. 5 differs from that of FIG. 3 in that a method of applying each parameter is performed only on rear channels when the correction for having the listener recognize that he or she listens in the optimal listening space is performed.

The reason why each parameter is applied only to the rear channels is as follows. When the HRTF is typically used to localize the virtual source in rear of the listener 1000, recognition ability of humans may cause confusion between the virtual source and the front localized virtual source. Accordingly, each parameter is applied only to the rear channels to remove such confusion, which puts an emphasis on the ability of rear space recognition of humans so that each parameter is applied only to the rear channels so as to have the listener 1000 recognize the virtual sources which are rear-localized.

The virtual listening space correcting unit 650 according to the present exemplary embodiment reads out virtual listening space parameters stored in the virtual listening space parameter storing unit 640, and applies them to the synthesizing unit 630.

The synthesizing unit 630 according to the present exemplary embodiment has a final left synthesizing unit 631 and a final right synthesizing unit 633. In addition, it has an intermediate left synthesizing unit 635 and an intermediate right synthesizing unit 637.

Audio data input to the left HRTFs H11 and H21 among audio data input to the front channels INPUT1 and INPUT2 pass through the left HRTFs H11 and H21 to be output to the final left synthesizing unit 631. In addition, audio data input to the right HRTFs H12 and H22 Among audio data input to the front channels INPUT1 and INPUT2 pass through the right HRTFs H12 and H22 to be output to the final right synthesizing unit 633.

In the meantime, audio data input to the left HRTF H31 among audio data output from the rear channel INPUT3 pass through the left HRTF H31 to be output to the intermediate left synthesizing unit 635 as left virtual sources. In addition, audio data input to the right HRTF H32 among audio data output from the rear channel INPUT3 pass through the right HRTF H32 to be output to the intermediate right synthesizing unit 637 as right virtual sources. Only one rear channel INPUT3 is shown in the drawing for simplicity of drawings, however, the number of the rear channel may be two or more.

The intermediate right and left synthesizing units 635 and 637 synthesize virtual listening space parameters and right and left virtual sources input from the rear channel INPUT3, respectively. And the left virtual sources synthesized in the intermediate left synthesizing unit 635 are output to the final left synthesizing unit 631, and the right virtual sources synthesized in the intermediate right synthesizing unit 637 are output to the final right synthesizing unit 633, respectively.

The final right and left synthesizing units 631 and 633 synthesize virtual sources output from the intermediate right and left synthesizing units 635 and 637, and virtual sources output directly from the HRTFs.

Sound signals resulted from the final right and left virtual sources which are synthesized in the final right and left synthesizing units 631 and 633 are externally output through the right and left speakers 220 and 210, respectively.

Figure 6:
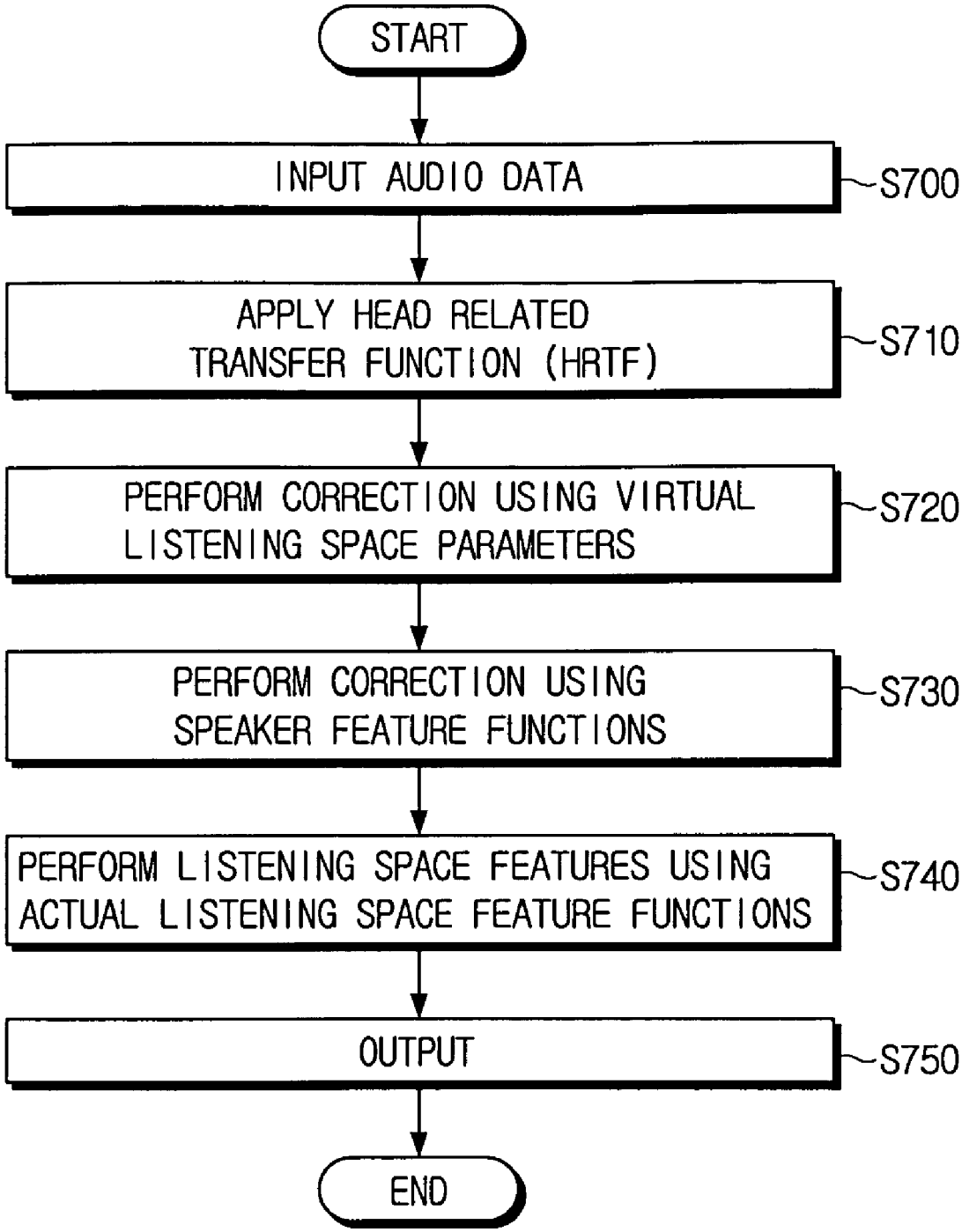
FIG. 6 is a flow chart for explaining a method of reproducing sounds in accordance with an exemplary embodiment of the present invention.

FIG. 6 is a flow chart for explaining a method of reproducing sounds in accordance with exemplary embodiments of the present invention.

Referring to FIGS. 1, 2, 3, and 6, when audio data are first input through input channels (step S700), the input audio data are applied to the right and left HRTFs H11, H12, H21, H22, H31, and H32 (step S710).

Right and let virtual sources output from the right and left HRTFs H11, H12, H21, H22, H31, and H32 are synthesized per right and left HRTFs, respectively, wherein they are synthesized including pre-set virtual listening space parameters. That is, the virtual listening space parameters are applied to correct the right and left virtual sources (step S720).

In addition, the corrected virtual sources synthesized with the pre-set speaker feature functions per right and left HRTFs so that the speaker features are corrected (step S730). In this case, the speaker feature functions means ones having properties only regarding the speaker features. Accordingly, the actual listening environment feature function as described above may be applied.

In the meantime, the virtual sources in which the speaker features are corrected are synthesized with the actual listening space feature functions per right and left HRTFs so that the actual listening space features are corrected (step S740). In this case, the actual listening space feature functions means ones having properties only regarding the actual listening space features. Accordingly, the actual listening environment feature function as described above may be applied.

As such, the virtual sources corrected in the steps 720, 730, and 740 are output to the listener 1000 through the right and left speakers 220 and 210 (step S750). Alternatively, the steps 720, 730, and 740 may be performed in any order.

According to the sound reproducing apparatus and the sound reproducing method of the exemplary embodiments of the present invention, the actual listening space may be corrected so that the optimal virtual sources in response to each listening space may be obtained. In addition, the speaker features may be corrected so that the optimal virtual sources in response to each speaker may be obtained. Moreover, sounds may be corrected so as have listeners recognize that they listen in a virtual listening space, so that they may fee that they listen in an optimal listening space.

In addition, a spatial transfer function is not used in order to correct the distorted sound, so that a large amount of calculation is not required and a memory having relatively high capacity is not yet required.

Accordingly, causes of each distortion may be removed to provide sounds having the best quality when listeners listen to the sounds through the virtual sources.

The foregoing exemplary embodiments and advantages are merely exemplary and are not to be construed as limiting the present invention. The present teaching can be readily applied to other types of apparatuses. Also, the description of the exemplary embodiments of the present invention is intended to be illustrative, and not to limit the scope of the claims, and many alternatives, modifications, and variations will be apparent to those skilled in the art.

What is claimed is:

1. A sound reproducing apparatus in which audio data input through input channels is generated as a virtual source by a Head Related Transfer Function (HRTF) and a sound signal resulting from the generated virtual source is output through a speaker, comprising:

an actual listening environment feature function database where an actual listening space feature function is stored for correcting the virtual source in response to a feature of an actual listening space provided at the time of listening;

an actual listening space feature correcting unit reading out the actual listening space feature function stored in the actual listening environment feature function database, and correcting the virtual source based on the reading result; and a band pass filter disposed between the actual listening environment feature function database and the actual listening space feature correcting unit, wherein the actual listening space feature function comprises a first reflected sound function portion and a late reflected sound function portion, the band pass filter extracts the first reflected sound function portion from the actual listening space feature function output from the actual listening environment feature function database and outputs only the first reflected sound function portion to the actual listening space feature correcting unit, and the actual listening space correcting unit corrects the virtual sources based on the first reflected sound function portion extracted by the band pass filter.

2. The sound reproducing apparatus as recited in claim 1, further comprising:

a speaker feature correcting unit reading out a speaker feature function stored in the actual listening environment feature function database and correcting the virtual source based on the reading result, wherein the speaker feature function for correcting the virtual source in response to the speaker feature provided at the time of listening is further stored in the actual listening environment feature function database.

3. The sound reproducing apparatus as recited in claim 1, further comprising:

a virtual listening space parameter storing unit storing a virtual listening space parameter set to allow the sound signal resulting from the virtual source to be output to an expected optimal listening space; and a virtual listening space correcting unit reading out the virtual listening space parameter stored in the virtual listening space parameter storing unit, and correcting the virtual source based on the reading result.

4. The sound reproducing apparatus as recited in claim 3, wherein the virtual listening space correcting unit performs correction only on a portion of the virtual source corresponding to audio data input from a front channel among the input channels.

5. The sound reproducing apparatus as recited in claim 3, wherein the virtual listening space correcting unit performs correction only on a portion of the virtual source corresponding to audio data input from a rear channel among the input channels.

6. The sound reproducing apparatus as recited in claim 1, wherein the actual listening environment feature function is measured at a predetermined external input device.

7. A sound reproducing apparatus in which audio data input through input channels are generated as virtual sources by a Head Related Transfer Function (HRTF) and a sound signal resulting from the generated virtual sources is output through a speaker, comprising:

an actual listening environment feature function database where a speaker feature function measured at a listening position of a listener is stored for correcting the virtual sources in response to a feature of a speaker provided at the time of listening;

a speaker feature correcting unit reading out the speaker feature function stored in the actual listening environment feature function database, and correcting the virtual sources based on the reading result; and a low pass filter disposed between the actual listening environment feature function database and the speaker feature correcting unit, wherein an actual listening space feature function stored in the actual listening environment feature function database comprises a direct sound function portion and a reflected sound function portion, the low pass filter receives the actual listening environment feature function from the actual listening environment feature function database, extracts the direct sound function portion from the actual listening space feature function and outputs only the direct sound function portion as the speaker feature function to the speaker feature correcting unit, and the speaker feature correcting unit corrects the virtual sources based on the direct sound function portion extracted by the low pass filter.

8. The sound reproducing apparatus as recited in claim 7, further comprising:

a virtual listening space parameter storing unit storing a virtual listening space parameter set to allow the sound signal resulting from the virtual source to be output to an expected optimal listening space; and a virtual listening space correcting unit reading out the virtual listening space parameter stored in the virtual listening space parameter storing unit, and correcting the virtual sources based on the reading result.

9. The sound reproducing apparatus as recited in claim 7, wherein the virtual listening space correcting unit performs correction only on the virtual sources corresponding to audio data input from a front channel among the input channels.

10. The sound reproducing apparatus as recited in claim 7, wherein the virtual listening space correcting unit performs correction only on the virtual sources corresponding to audio data input from a rear channel among the input channels.

11. A sound reproducing apparatus in which audio data input through input channels are generated as virtual sources by a Head Related Transfer Function (HRTF) and a sound signal resulting from the generated virtual sources is output through a speaker, comprising:

a virtual listening space parameter storing unit storing a virtual listening space parameter set to allow the sound signal resulted from the virtual sources to be output to an expected optimal listening space;

a virtual listening space correcting unit reading out the virtual listening space parameter stored in the virtual listening space parameter storing unit, and correcting the virtual sources based on the reading result; and a band pass filter disposed between the virtual listening space parameter storing unit and the virtual listening space correcting unit, wherein the virtual listening space parameter comprises a first reflected sound function portion and a late reflected sound function portion, the band pass filter extracts the first reflected sound function portion from the virtual listening space parameter output from the virtual listening space parameter storing unit and outputs only the first reflected sound function portion to the virtual listening space correcting unit, and the virtual listening space correcting unit corrects the virtual sources based on the first reflected sound function portion extracted by the band pass filter.

12. The sound reproducing apparatus as recited in claim 11, wherein the virtual listening space correcting unit performs correction only on the virtual sources corresponding to audio data input from a front channel among the input channels.

13. The sound reproducing apparatus as recited in claim 11, wherein the virtual listening space correcting unit performs correction only on the virtual sources corresponding to audio data input from a rear channel among the input channels.

14. A sound reproducing method in which audio data input through input channels are generated as virtual sources by a Head Related Transfer Function (HRTF) and a sound signal resulting from the generated virtual sources is output through a speaker, comprising:

(a) correcting the virtual sources based on an actual listening space feature function for correcting the virtual sources in response to a feature of an actual listening space provided at the time of listening, wherein the actual listening space feature function comprises a first reflected sound function portion and a late reflected sound function portion, and the (a) correcting the virtual sources is performed based only on the first reflected sound function portion of the first reflected sound function portion and the late reflected sound function portion.

15. The sound reproducing method as recited in claim 14, further comprising:

(b) correcting the virtual sources based on a speaker feature function for correcting the virtual sources in response to a feature of an actual listening space provided at the time of listening.

16. The sound reproducing method as recited in claim 14, further comprising:

(c) correcting the virtual sources based on a virtual listening space parameter set to allow the sound signal resulted from the virtual source to be output to an expected optimal listening space.

17. The sound reproducing method as recited in claim 16, wherein the (c) correcting the virtual sources is performed only on the virtual sources corresponding to audio data input from a front channel among the input channels.

18. The sound reproducing method as recited in claim 16, wherein the (c) correcting the virtual sources is performed only on the virtual sources corresponding to audio data input from a rear channel among the input channels.

19. A sound reproducing method in which audio data input through input channels are generated as virtual sources by a Head Related Transfer Function (HRTF) and a sound signal resulting from the generated virtual sources is output through a speaker, comprising:

(A) correcting the virtual sources based on a speaker feature function measured at a listening position of a listener for correcting the virtual sources in response to a feature of a speaker provided at the time of listening, wherein an actual listening space feature function stored in the actual listening environment feature function database comprises a direct sound function portion and a reflected sound function portion, and the (A) correcting the virtual sources is performed based only on the direct sound function portion of the direct sound function portion and the reflected sound function portion.

20. The sound reproducing method as recited in claim 19, further comprising:

(B) correcting the virtual sources based on a virtual listening space parameter set to allow the sound signal resulted from the virtual sources to be output to an expected optimal listening space.

21. The sound reproducing method as recited in claim 20, wherein the (B) correcting the virtual source is performed only on the virtual sources corresponding to audio data input from a front channel among the input channels.

22. The sound reproducing method as recited in claim 20, wherein the (B) correcting the virtual source is performed only on the virtual sources corresponding to audio data input from a rear channel among the input channels.

23. A sound reproducing method in which audio data input through input channels are generated as virtual sources by a Head Related Transfer Function (HRTF) and a sound signal resulting from the generated virtual sources is output through a speaker, comprising:

correcting the virtual sources based on a virtual listening space parameter set to allow the sound signal resulted from the virtual sources to be output to an expected optimal listening space, wherein the virtual listening space parameter comprises a first reflected sound function portion and a late reflected sound function portion, and the (a) correcting the virtual sources is performed based only on the first reflected sound function portion of the first reflected sound function portion and the late reflected sound function portion.

24. The sound reproducing method as recited in claim 23, wherein correcting the virtual sources is performed only on the virtual sources corresponding to audio data input from a front channel among the input channels.

25. The sound reproducing method as recited in claim 23, wherein correcting the virtual source is performed only on the virtual sources corresponding to audio data input from a rear channel among the input channels.

26. The sound reproducing apparatus as recited in claim 11, wherein the virtual listening space parameter comprises at least one of an atmospheric absorption degree, a reflectivity and a size of a virtual listening space which represents an idealistic listening space.

* * * * *